US005282371A

United States Patent [19]

Otsuki

[11] Patent Number: 5,282,371

[45] Date of Patent: Feb. 1, 1994

[54] CIRCULAR KNITTING MACHINE WITH MAGNETIC ACTUATED NEEDLE SELECTION

[75] Inventor: Masamitsu Otsuki, Osaka, Japan

[73] Assignee: I-TEC Hanshin Co., Ltd., Osaka, Japan

[21] Appl. No.: 47,603

[22] Filed: Apr. 14, 1993

Related U.S. Application Data

[63] Continuation-in-part of Ser. No. 942,686, Sep. 9, 1992.

[30] Foreign Application Priority Data

Jul. 8, 1992 [JP] Japan ..... 4-180765

[51] Int. Cl.[5] ..... D04B 9/00; D04B 15/66

[52] U.S. Cl. ..... 66/13; 66/215

[58] Field of Search ..... 66/8, 13, 56, 57, 215

[56] References Cited

U.S. PATENT DOCUMENTS 5,018,369 5/1991 Lonati .

*Primary Examiner*—Clifford D. Crowder
*Assistant Examiner*—John J. Calvert
*Attorney, Agent, or Firm*—Jordan and Hamburg

[57] ABSTRACT

The invention relates to a circular knitting machine comprising a stationary hollow cylinder, a rotor disposed within the stationary hollow cylinder and adapted to revolve in coaxial relation with the stationary hollow cylinder, a plurality of coils disposed on the internal circumferential surface of the stationary hollow cylinder, a plurality of sliders disposed in vertically slidable relation on the external circumferential surface of the rotor, needles mounted on top of the corresponding sliders, a coil energizing means for exciting the plurality of coils, and a driving means for driving the rotor.

5 Claims, 16 Drawing Sheets

THE POSITION OF THE NEEDLE

THE POSITION OF THE SILINDER

THE EXCITATION FOR THE COILS

CIRCULAR KNITTING MACHINE WITH MAGNETIC ACTUATED NEEDLE SELECTION

This application is a continuation-in-part of application Ser. No. 07/942,686 filed Sep.9, 1992.

FIELD OF THE INVENTION

The present invention relates to a circular knitting machine.

BACKGROUND OF THE INVENTION

Since the advent of a circular knitting machine, there has been no change in the basic mechanism used for driving its needles in which the needle cylinder is driven to move the needle up and down along the contour of a knitting cam disposed under the needle cylinder.

However, since the vertical motion of the needle is determined by the configuration of said cam, the following problems are inevitable.

(1) The motion of the needle is delimited by the shape of the knitting cam. For example, depending on the shape of the adjacent cam, the motion wanted by the operator may be physically impossible to obtain.

(2) In order to vary the motion of needles, it is necessary to exchange the cams. Since this exchange is a time-consuming job, much hesitancy must be overcome to set a new needle motion.

(3) In the trouble-shooting of a circular knitting machine, it is necessary to verify that the knitting cams have not been worn out of shape but the above mechanical complexity is a major drawback in the maintenance of the circular knitting machine.

The present invention provides a circular knitting machine which does not require knitting cams which lie at the base of the above-mentioned problems.

SUMMARY OF THE INVENTION

The circular knitting machine in accordance with a first embodiment of the invention comprises a stationary hollow cylinder, a rotor disposed within said stationary cylinder and adapted to revolve coaxially therewith, a plurality of coils disposed on the internal circumferential surface of said stationary hollow cylinder, a plurality of sliders disposed in vertically slidable relation on the external circumferential surface of said rotor and adapted to slide vertically on excitation of said coils, a plurality of needles disposed on top of said respective sliders, a coil energizing means for exciting said plurality of coils, and a drive means for driving said rotor.

The circular knitting machine in accordance with a second embodiment of the invention is a machine of the first embodiment wherein said plurality of coils are disposed in the form of a grating as viewed by developing the internal circumferential surface of said stationary hollow cylinder, means energizes the coils disposed in the manner of a grating in a sequence from bottom to top along the rotational direction of the rotor to generate magnetic attraction forces to cause the sliders on the revolving rotor to be shifted upwards as they traverse the serially excited coils. Alternatively, the coil energizing means energizes the coils disposed in the manner of a grating in a sequence from top to bottom along the rotational direction of the rotor to generate magnetic attraction forces to thereby cause the sliders on the revolving rotor to be shifted downwards as they traverse the serially excited coils.

The circular knitting machine in accordance with the third embodiment is the machine of the second embodiment which further comprises a data input means for inputting circumferential direction data representing the relative circumferential positions of the stationary hollow cylinder and rotor, for driving the needles vertically, and distance data representing the vertical distance of movement of the needles in the circumferential position, coil excitation setting means for determining the coils to be excited among the plurality of coils according to the circumferential direction data and distance data input from the input means, and coil excitation control means for controlling the coil energizing means to energize the coils designated by the coil excitation setting means.

Referring to the circular knitting machine of the first embodiment, the mechanism of driving the needles in the vertical direction will now be described.

The plurality of coils disposed on the internal circumferential surface of the stationary hollow cylinder are selectively energized by the coil energizing means. The rotor rotates in coaxial relation to the stationary hollow cylinder. The sliders disposed on the outer circumferential surface of the rotor are rotated together with the rotor as a unit and when any slider traverses the excited coil, it is shifted up or down by the magnetic attraction force of the coil, with the result that the needle mounted on top of the slider is driven up or down.

The mechanism for driving the needles up and down in the circular knitting machine of the second embodiment will now be described.

The coils of the plurality of coils are disposed in the manner of a grating as viewed by developing the internal circumferential surface of the stationary hollow cylinder. In order to raise the slider in this arrangement, the coil energizing means is actuated to energize the coils disposed in the manner of a grating in a sequence from bottom to top along the rotational direction of the rotor to generate magnetic attraction forces to thereby cause the slider on the revolving rotor to be raised by the magnetic force of the coil as it traverses the excited coil. To lower the needle, the coil energizing means selectively energizes the coils disposed in the manner of a grating in a sequence from top to bottom along the rotational direction of the rotor to generate magnetic attraction forces to thereby cause the slider on the revolving rotor to be lowered by the magnetic force of the coil as it traverses the excited coil.

The mechanism for driving the needles vertically in the circular knitting machine of the third embodiment will now be described in detail.

The input means is supplied with circumferential direction data representing the circumferential position of the stationary hollow cylinder or rotor for driving the needles vertically and distance data representing the vertical distance of movement of the needle in the circumferential position. The coil excitation setting means determines the coils to be excited among the plurality of coils according to the circumferential direction data and distance data input from the input means. The coil excitation control means controls the coil energizing means to excite the coils designated by the coil excitation setting means.

Since the input means is supplied with a set of needle motion (circumferential direction data and distance data) data for the fabrication of a stocking, for instance, the coil setting means determines an excitation pattern, i.e. the pattern of coils to be excited, according to the needle motion data. The coil excitation control means controls the coil energizing means so that the coils will be excited in accordance with the excitation pattern.

Unlike a conventional circular knitting machine wherein the needles are driven by knitting cams, the circular knitting machine of the present invention employs the principle of a linear motor using coils and sliders and, therefore, is not subject to the mechanical problems of a cam operated structure.

Therefore, the motion of needles is not delimited by a cam configuration and, moreover, the machine is easy to maintain. Furthermore, the needle motion can be easily varied by merely changing the coil excitation pattern.

DETAILED DESCRIPTION OF THE PREFERRED EMBODIMENTS

Figure 1:
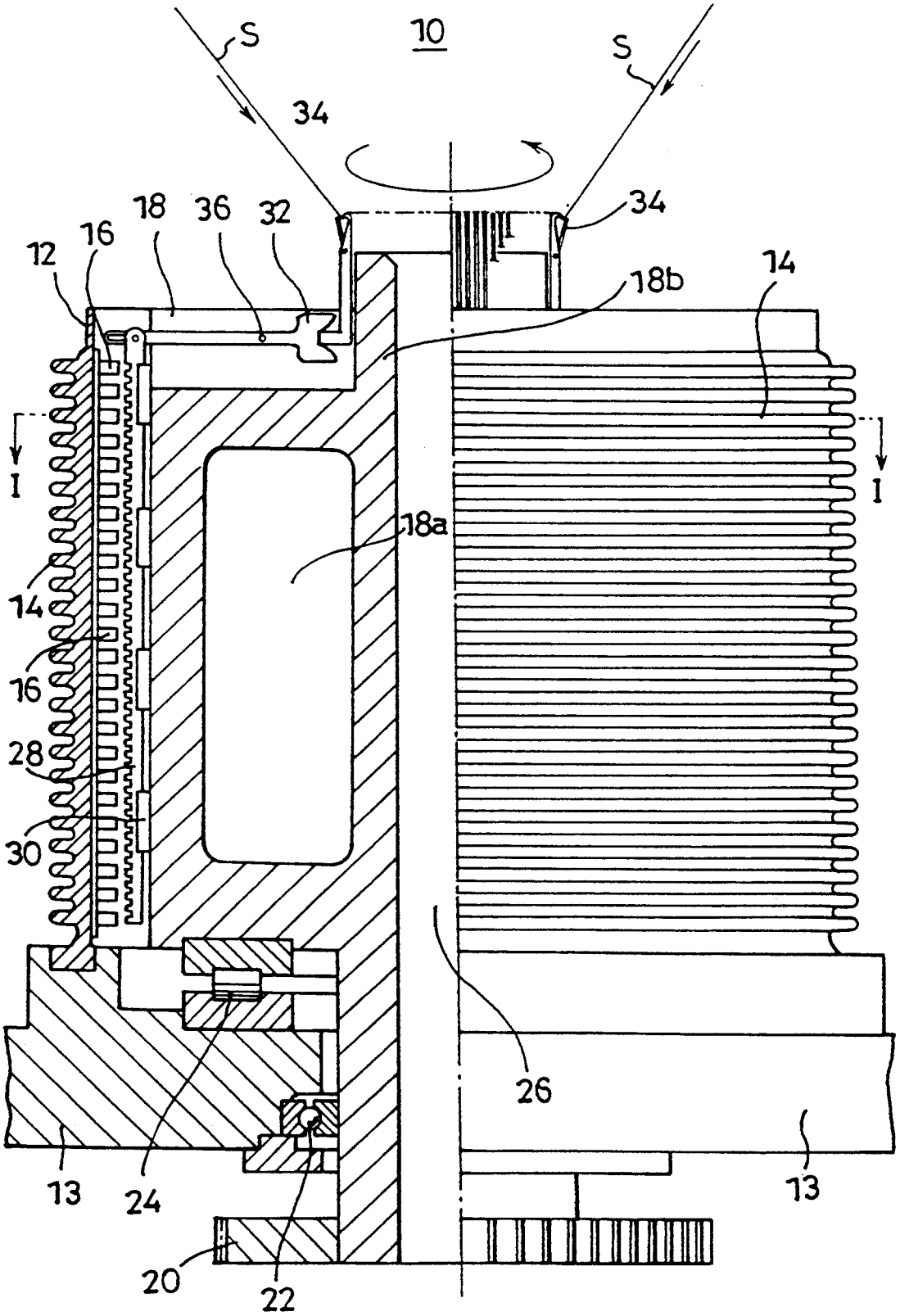
FIG. 1 is a vertical half-section view showing an embodiment of the invention.

The circular knitting machine 10 as an embodiment of the present invention is now described with reference to the drawings.

The reference numeral 12 indicates a stationary hollow cylinder which is rigidly mounted on a base 13. The external circumferential surface of this stationary cylinder 12 is provided with a plurality of cooling fins 14 for dissipation of heat at predetermined intervals, while the internal circumferential surface of said stationary hollow cylinder 12 is provided with a plurality of coils 16. The construction of the coils 16 will be described in detail hereinafter.

The reference numeral 18 indicates a rotor. The rotor 18 is disposed within said stationary hollow cylinder 12 in coaxially rotatable relation. The rotor 18 is provided with a timing pulley 20 at its lower end and is rotatable through a radial bearing 22 and a thrust bearing 24. The rotor 18 comprises a lower drum 18*a* and an upper drum 18*b* and the diameter of the upper drum 18*b* is smaller than that of the lower drum 18*a*. The rotor 18 is centrally formed with a cavity 26. As a yarn S supplied from the top of the rotor 18 is knitted into a circular fabric, it is accumulated in this cavity 26.

Figure 2:
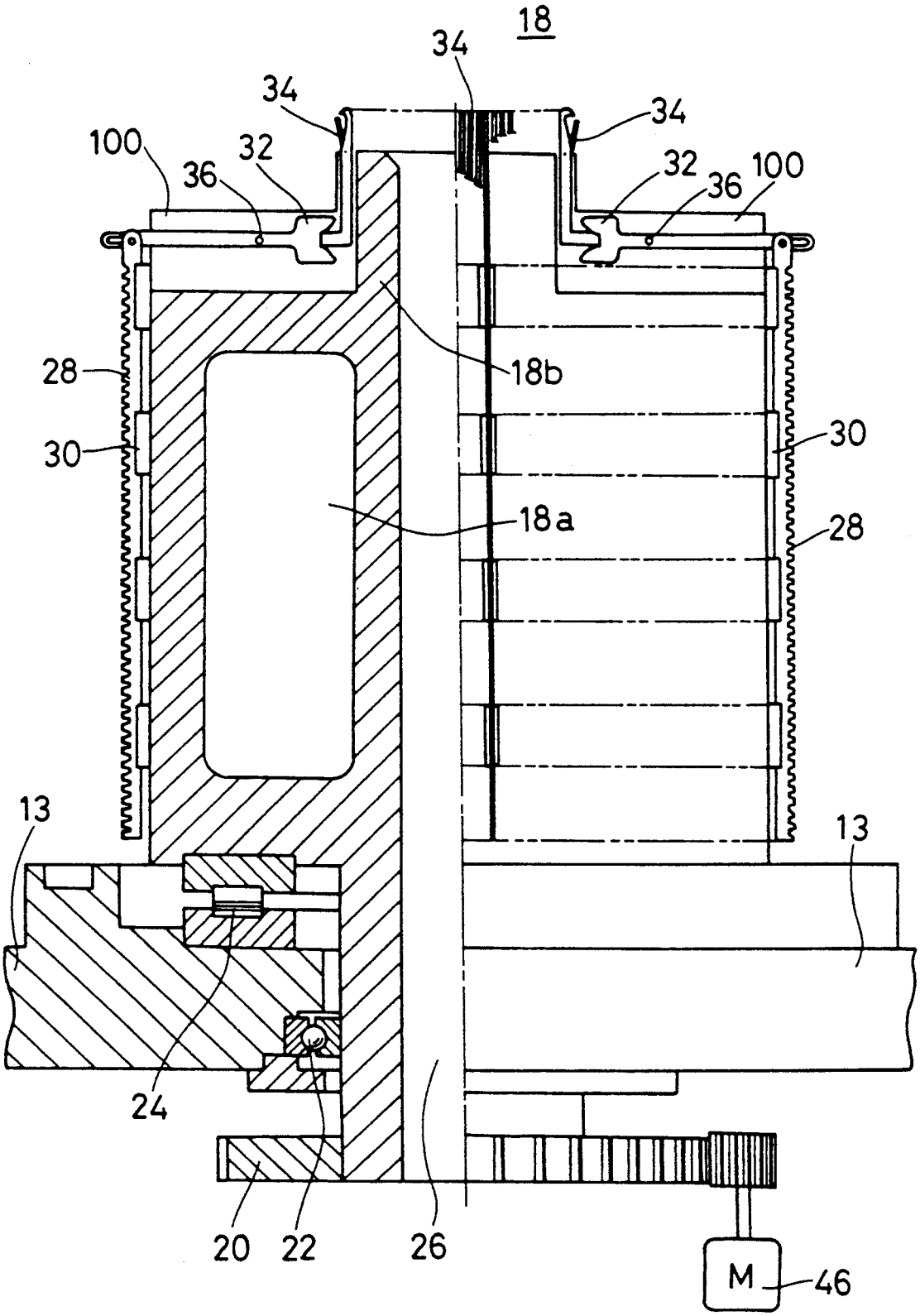
FIG. 2 is a vertical half-section view of the rotor.
Figure 3:
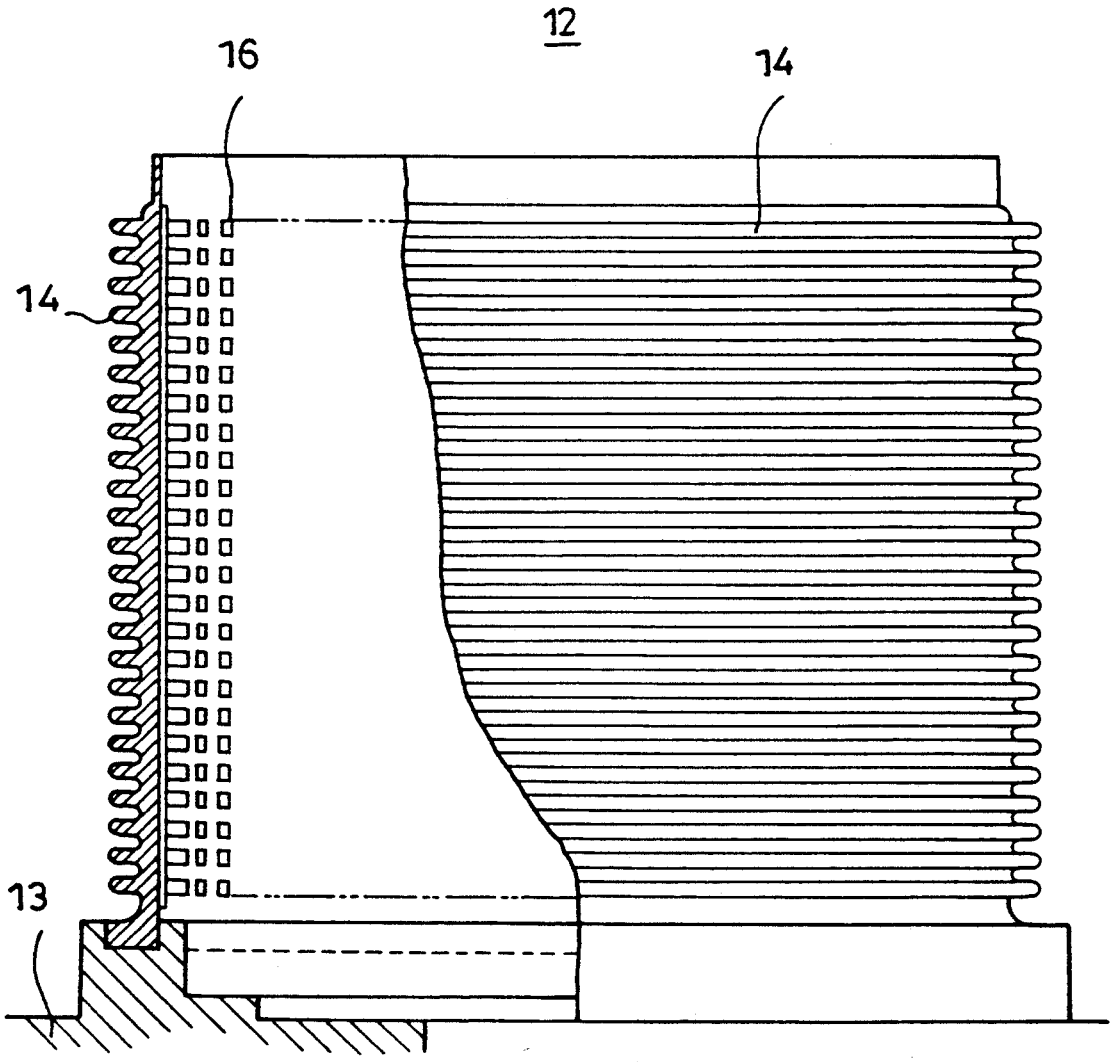
FIG. 3 is a vertical half-section view of the stationary hollow cylinder.

The rotor 18 rotates when a timing pulley 20 is driven by a servo motor 46 (FIG. 2). Thus, the rotor 18 is forced by the servo motor 46 to revolve within the stationary hollow cylinder.

The reference numeral 28 indicates a plurality of sliders disposed at predetermined intervals on the external circumferential surface of the lower drum 18*a*. The sliders 28 are supported by pairs of linear guides 30, 30 in vertically movable relation. The reference numeral 34 indicates a plurality of needles disposed at predetermined intervals on the external circumferential surface of the upper drum 18*b*. Each of the needles 34 is operatively associated with the top end of the corresponding slider 28 by way of a link 32. The slider 28 and the needle 34 are each provided in units of, for example, 200 along the entire circumference. The number of sliders 28 should correspond to the number of needles 34 and may range, for example, from 80 to 200. However, when the circular knitting machine is to be increased in size, the number of sliders 28 can also be increased. The link 32 is rotatable about a horizontal pivot 36 situated on top of the lower drum 18*a* so that as the slider 28 moves upwards, the link 32 turns to lower the needle 34. The construction of the slider 28 and that of the linear guides 30 will be described in detail hereinafter.

The mechanism by which the needles 34 are raised or lowered will now be described in detail.

Figure 15:
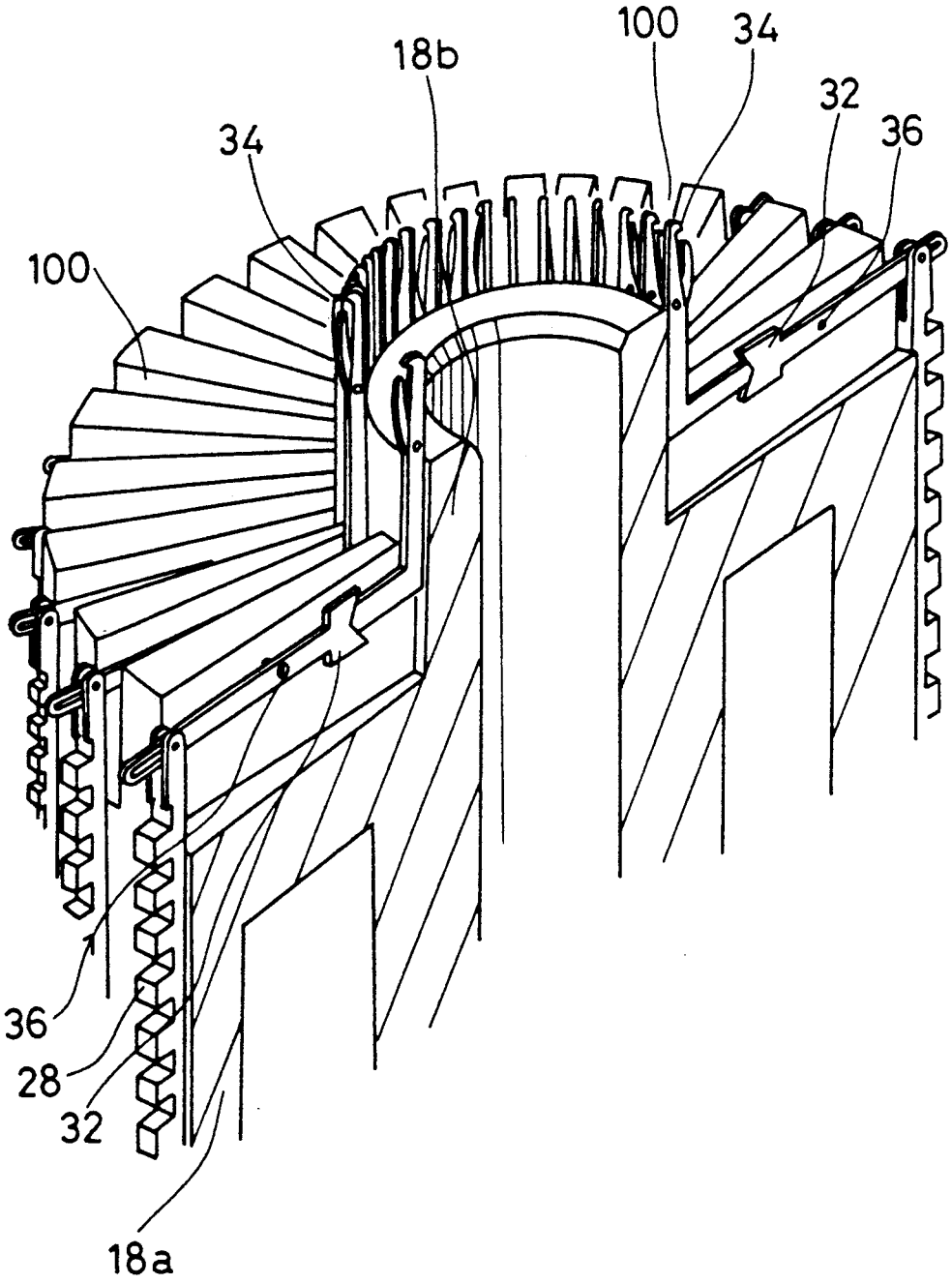
FIG. 15 is a perspective view showing the upper part of the rotor.
Figure 16:
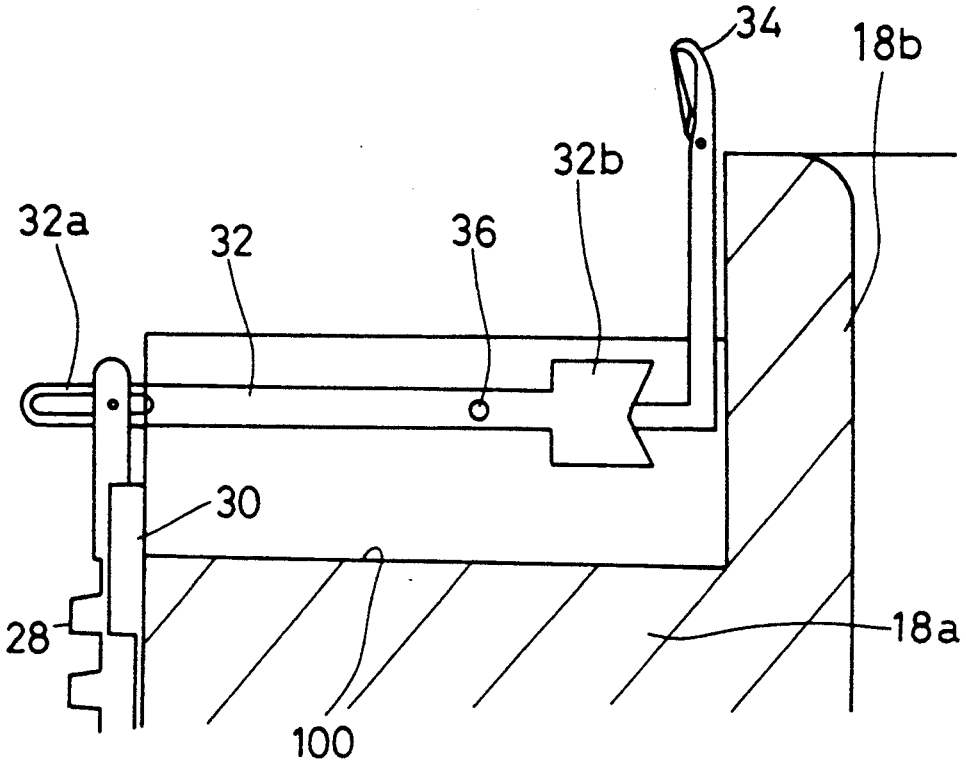
FIG. 16 is a longitudinal sectional view showing the needle in raised position.
Figure 17:
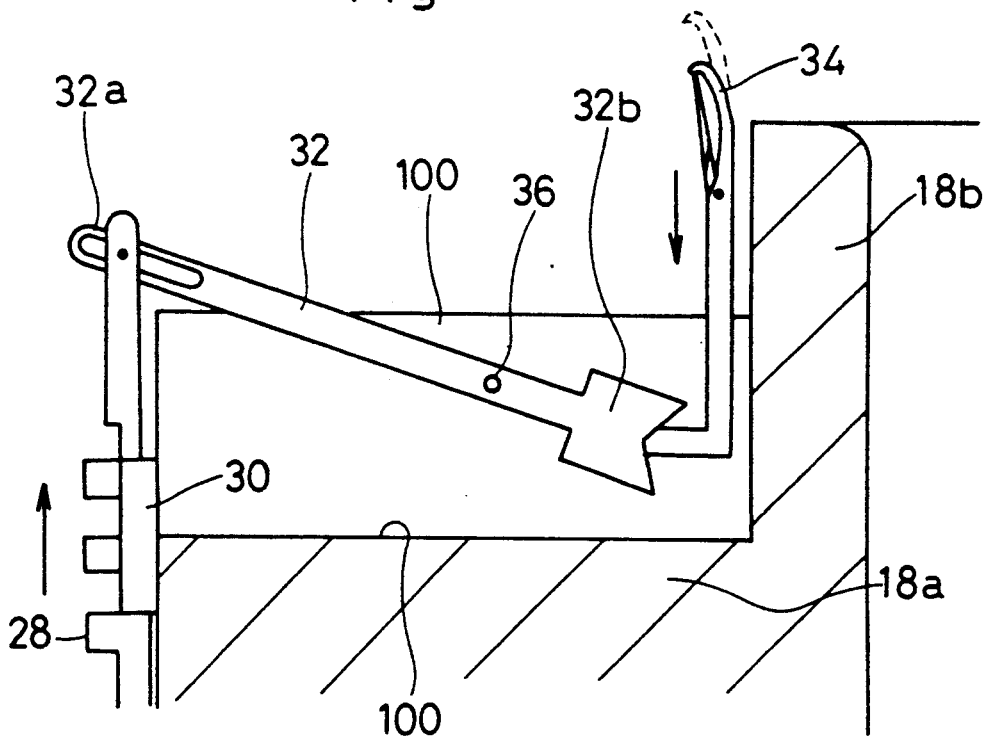
FIG. 17 is a longitudinal sectional view showing the needle in lowered position.

The upper surface of the lower drum 18*a* is provided with a plurality of radially extending grooves 100 arranged in circumferentially equidistantly spaced relation. Disposed in each groove 100 is a link 32 extending in a substantially horizontal direction, and this link 32 is freely rotatable about a pivot 36 (cf. FIGS. 15 and 16) extending between the sidewalls of the respective groove 100. Connected to the radially outward end 32*a* of the link 32 is the top end of the slider 28 which is disposed in vertical position. Connected to the radially inner end 32*b* of the link 32 is the lower end of the needle 34 which is disposed in vertical position. As shown in FIG 17, the outer end 32*a* of the link 32 is raised as the slider 28 rises, so that the inner end 32*b* of the link 32 is lowered according to the principle of leverage. As the inner end 32*b* of the link 32 descends, the needle 34 is also lowered. As the slider 28 descends, the needle 34 is raised. As seen in FIGS. 2 and 15, the needles are vertically guided in vertically extending extensions of the grooves 100. Further, conventional guide walls may be provided for the needles, if necessary.

The construction of coils 16 is now described.

Figure 8:
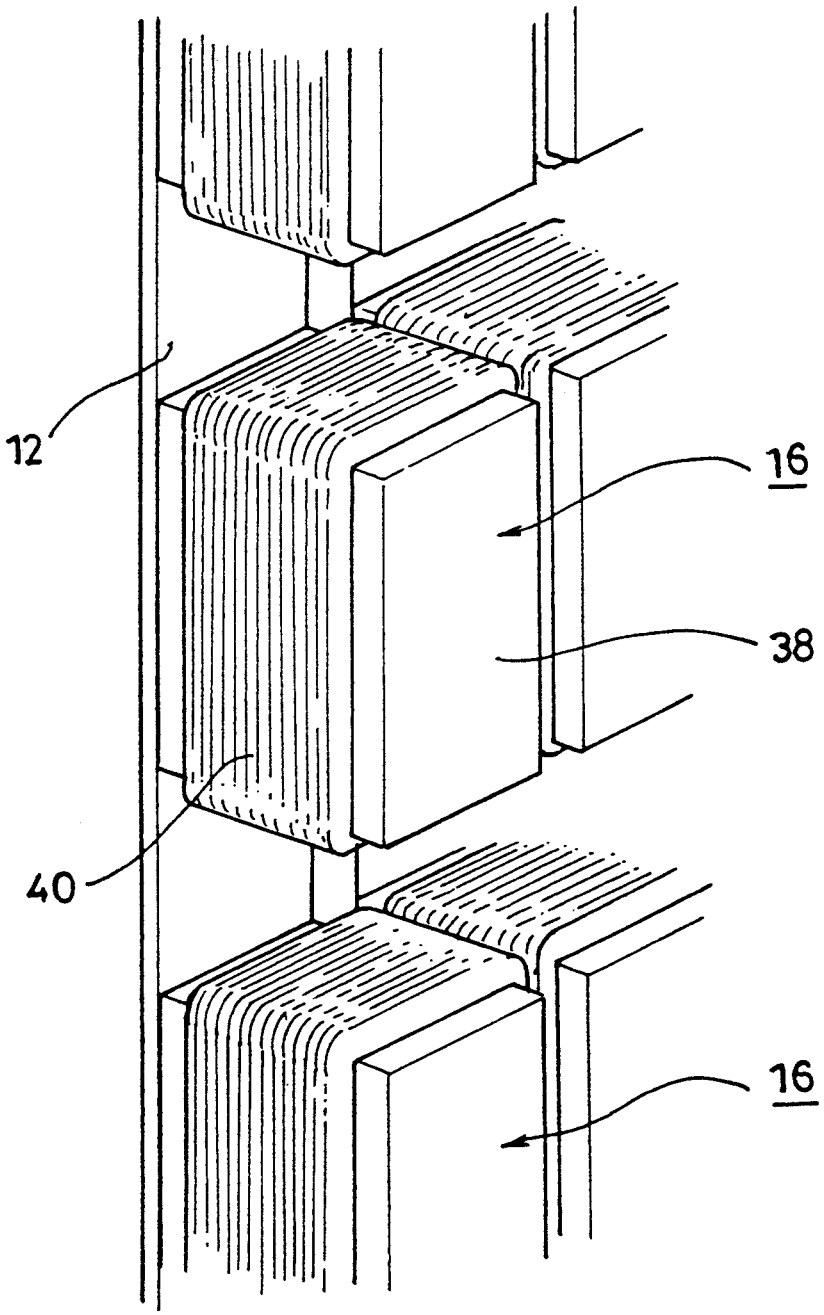
FIG. 8 is an enlarged perspective view of the coil.

As shown in FIG. 8, each coil 16 comprises an iron core 38 projecting inwards from the internal circumferential surface of the stationary hollow cylinder 18 and a coil winding 40 disposed around said iron core 38. As a current flows to the coil winding 40, the coil 16 is excited.

Figure 9:
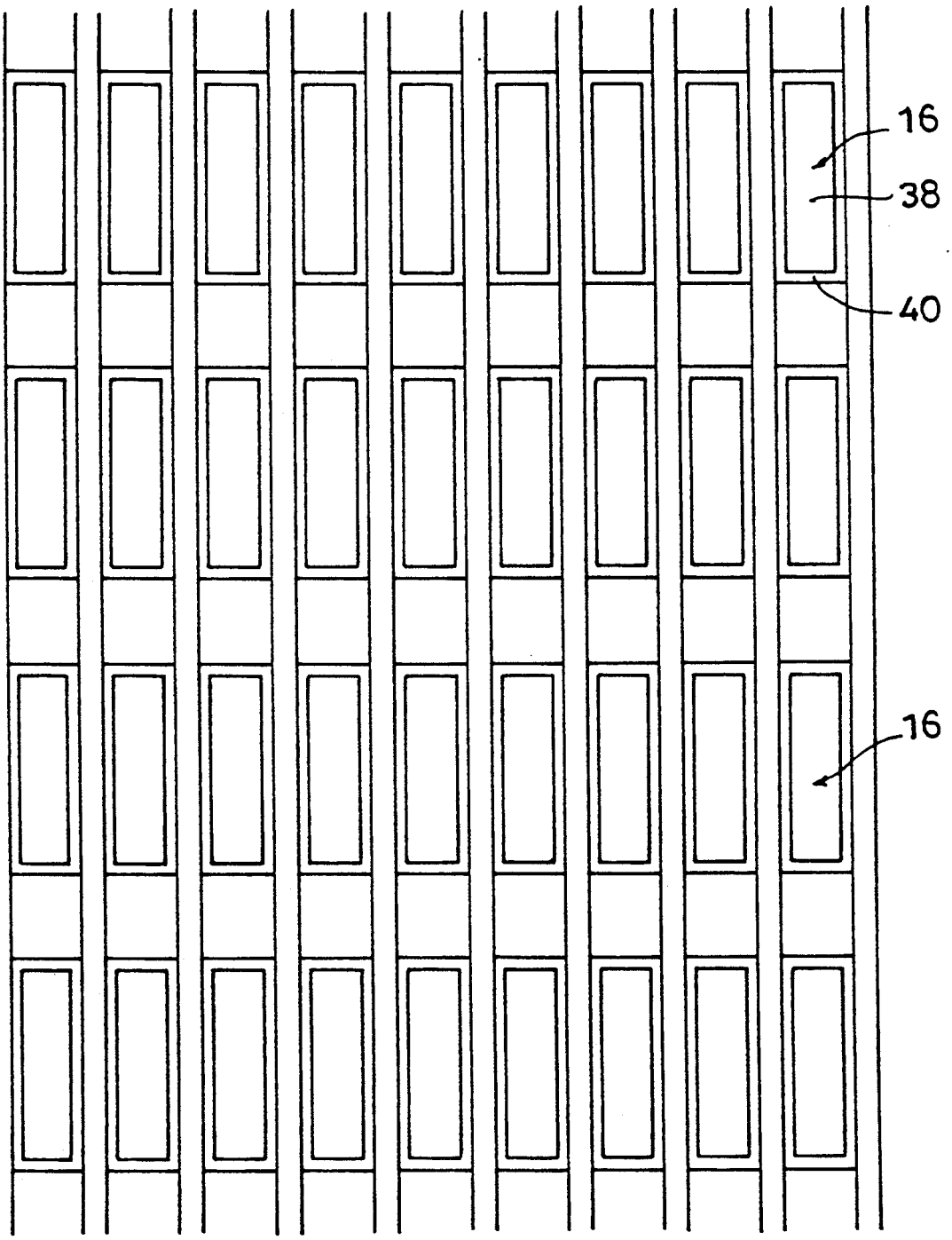
FIG. 9 is a front view of the coil.

As viewed by developing the internal circumferential surface of said stationary hollow cylinder 12 (FIG. 9), a plurality of coils 16 of the above construction are arranged longitudinally, viz. vertically, and transversely, viz. horizontally (in the direction of rotation), both at appropriate intervals (this arrangement of coils 16 is hereinafter referred to as "arranged in the form of a grating"). Thus, the coils 16 are arranged equidistantly spaced in the direction of rotation. The number of coils 16 in the longitudinal direction of the cylinder may be about 24 and the number of coils 16 in the direction of rotation may be about 200. The greater the number of coils 16 in the longitudinal and rotational directions, the smoother is the rotation of the needles 34.

The construction of the slider 28 and linear guides 30 is now described.

Figure 5:
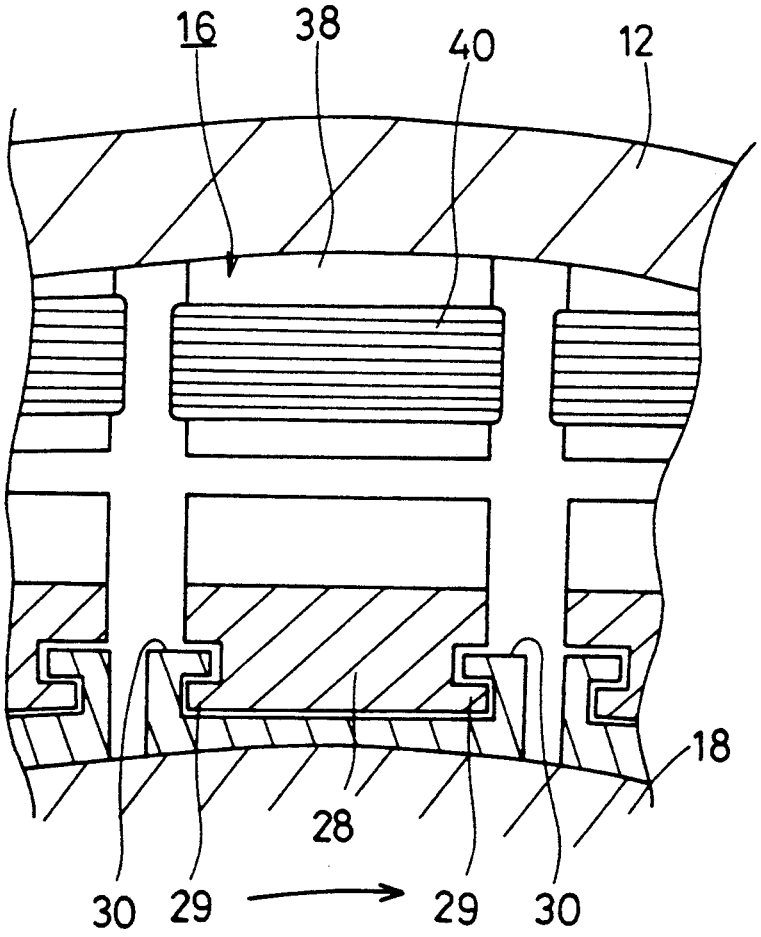
FIG. 5 is a horizontal section view of the coil and slider.
Figure 6:
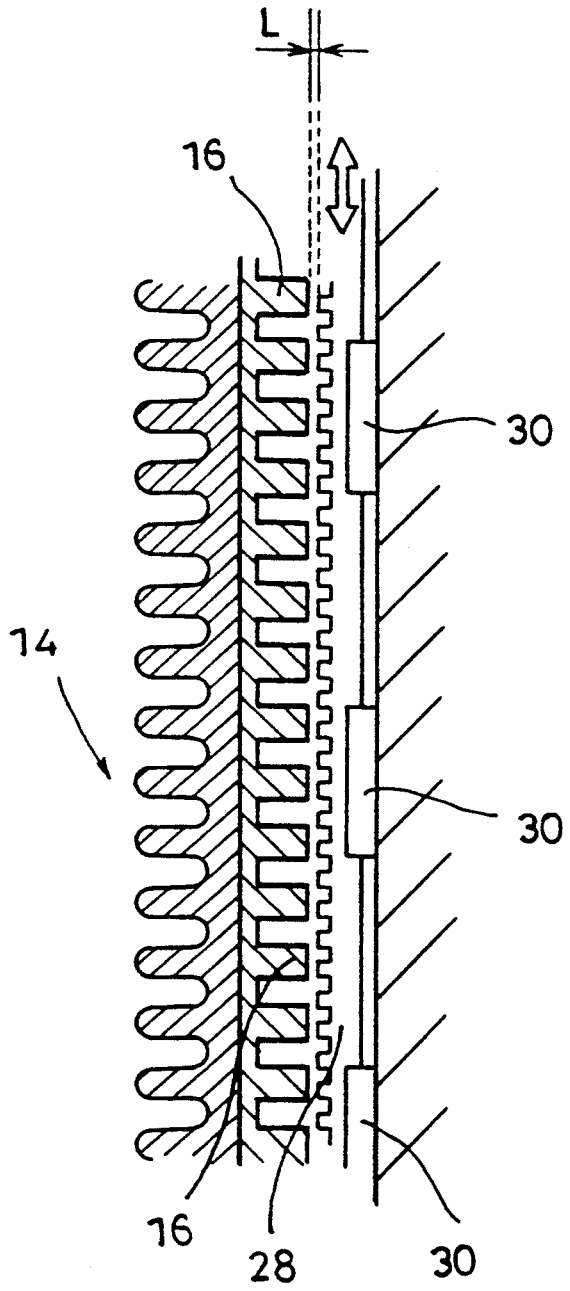
FIG. 6 is a vertical section view of the coil and slider.
Figure 7:
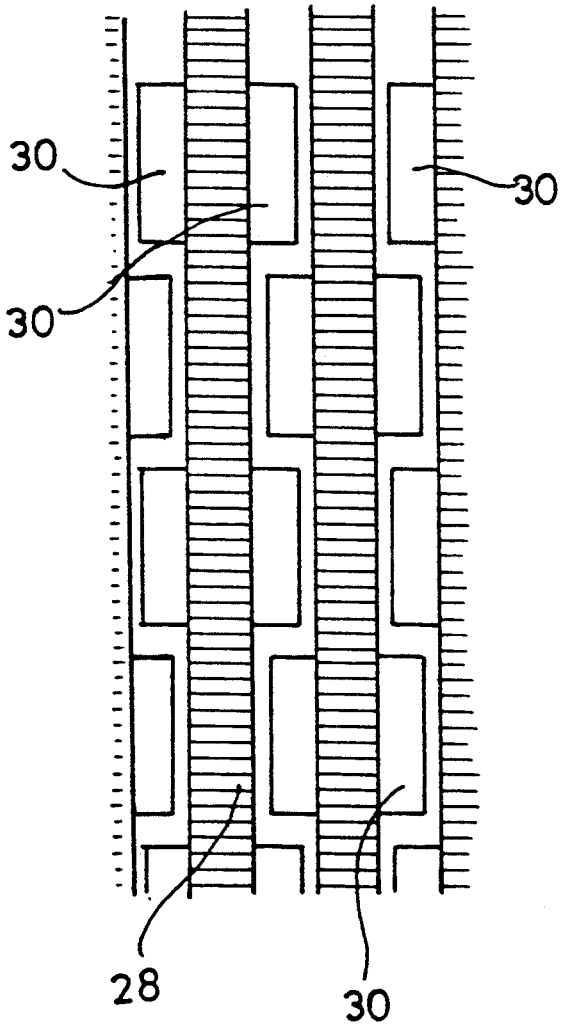
FIG. 7 is an enlarged front view showing the slider and linear guides.

A plurality of pairs of linear guides 30, 30 are disposed in the longitudinal direction on the external circumferential surface of the rotor 18. The slider 28 has a groove 29 on either side, by which the linear guide 30, 30 is engaged so that the slider 28 may move vertically with respect to the external circumferential surface of the rotor 18 (FIG. 5). The external (radially outer) surface of the slider 28 is roughened so that it may be more susceptible to the magnetic force of the coils 16. In other words, a linear motor is formed by the coils 16 and the slider 28. The gap L between the coils 16 and the slider 28 may be 0.5 mm to 1.5 mm (FIG. 6).

Figure 10:
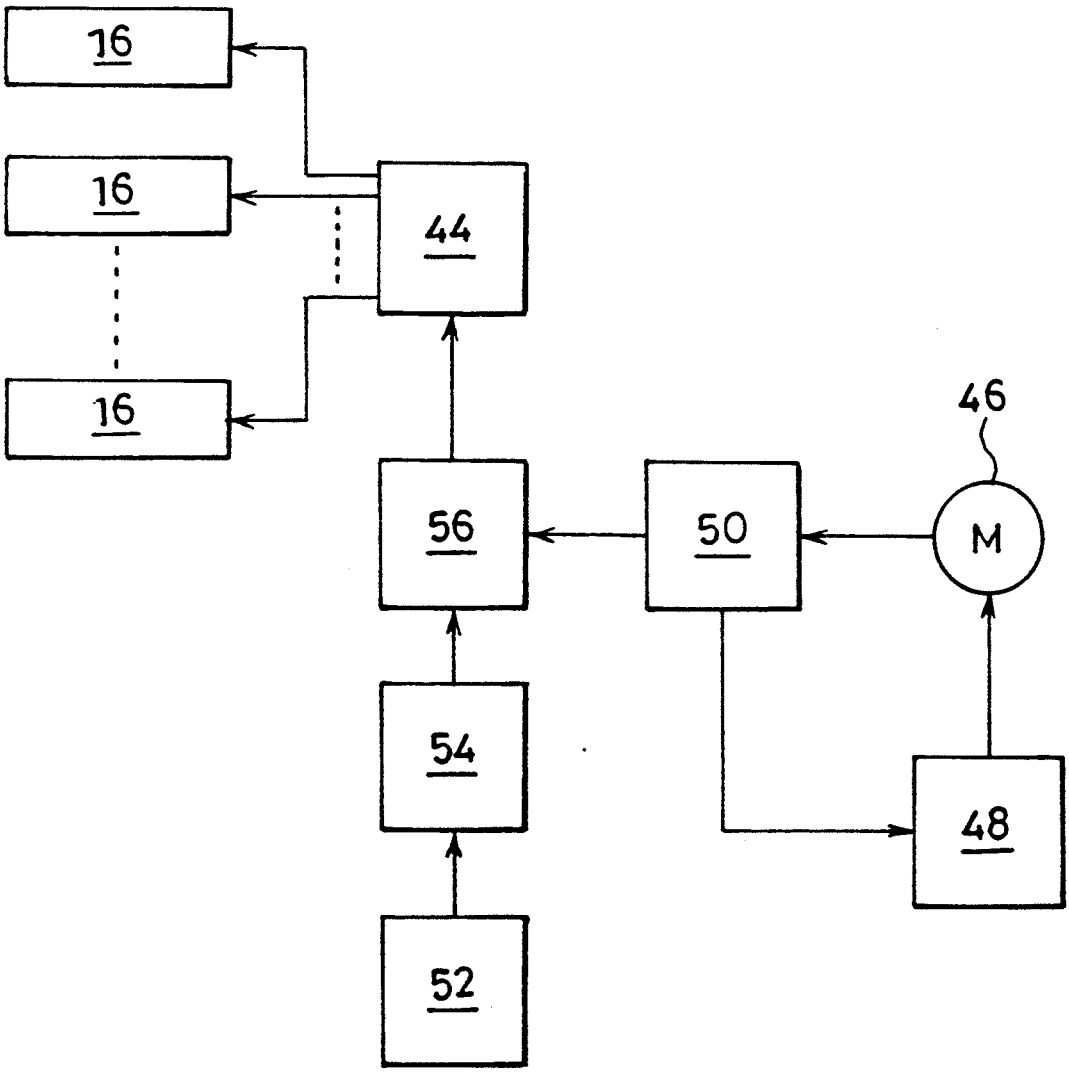
FIG. 10 is a block diagram for the circular knitting machine.

The mode of control of the circular knitting machine 10 is now explained with reference to the block diagram of FIG. 10.

The reference numeral 44 indicates a coil energizing unit for exciting said plurality of coils 16. The coil energizing unit 44 is adapted to individually excite the coils of said plurality of coils 16.

The reference numeral 46 indicates a servo motor for driving the rotor 18 through said timing pulley 20.

The reference numeral 48 indicates a driving circuit for driving the servo motor 46.

The reference numeral 50 indicates a rotation detector, such as an encoder, for detecting the speed and angle of rotation of said servo motor 46. The rotation signal from the rotation detector 50 is fed to the driving means 48 for feedback control insuring a constant rotational speed of the servo motor 46.

The reference numeral 52 indicates a converter for converting a pattern design image from a system such as a pattern design system into needle motions of the circular knitting machine 10. The converter 52 is provided with an external memory device such as a floppy disk and the pattern design data, such as that of a stocking, entered by the pattern design system and stored in the floppy disk, are fed from said external memory device to the converter 52. The converter 52 converts the data into the motion of needles 34 for circular knitting.

The reference numeral 54 indicates a setting device for converting needle motion data from the converter 52 into the coil excitation pattern.

The reference numeral 56 indicates a driver pattern controller for controlling the coil energizing device 44 according to the coil excitation pattern selected by the setting device 54.

The converter 52 for converting the image of a stocking, for instance, from the pattern design system into motions of needles 34 can be a device well-known in the art.

The actions of the setting device 54, driver pattern controller 56 and coil energizing device 44 will now be explained with reference to FIG. 11.

Figure 11A:
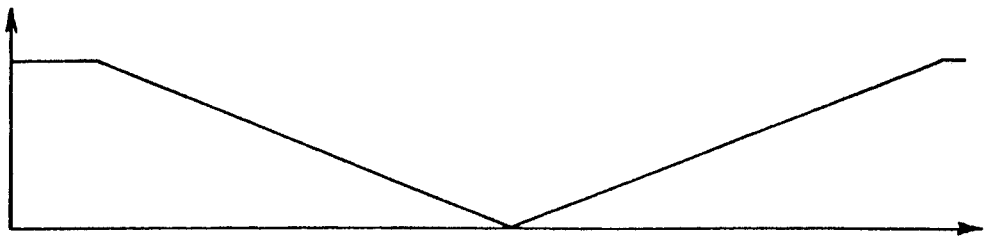
FIG. 11 is a schematic diagram for explaining the coil excitation pattern.
Figure 11B:
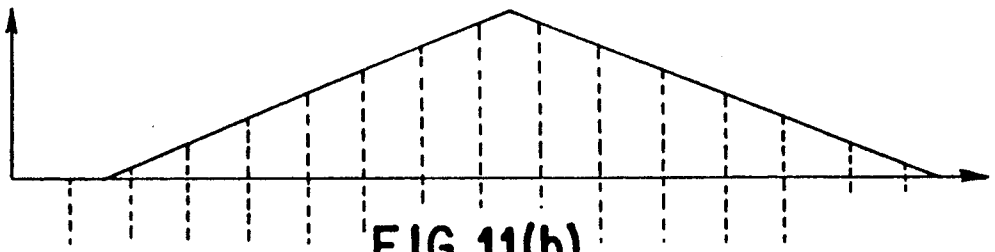
Figure 11C:
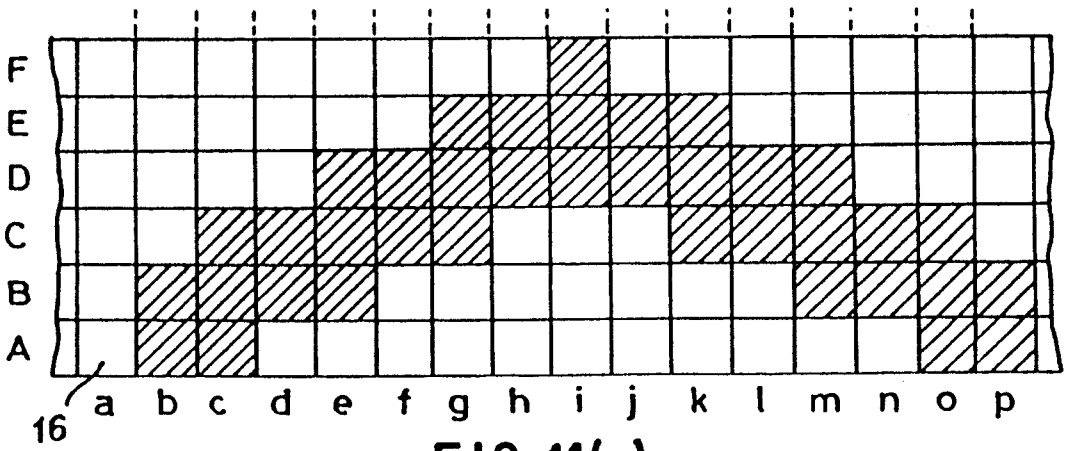

FIG. 11 (a) shows the position of a needle 34. The vertical axis represents the vertical position of the needle 34 and the horizontal axis represents the position of the same needle 34 in the direction of rotation. Here, the distance of vertical movement of the needle 34 is "the vertical distance". The position of the needle 34 in the direction of rotation on the horizontal axis is the "circumferential position".

FIG. 11 (*b*) shows the position of the slider 28. In the figure, the vertical axis represents the vertical position, while the horizontal axis represents the position of the slider 28 in the direction of rotation.

FIG. 11 (*c*) shows the excitation pattern for the coils 16. The vertical axis represents the positions of coils 16 arranged in the vertical direction and the horizontal axis represents the positions of coils 16 in the direction of rotation. The coils 16 to be excited are specified by selecting A, B . . . on the vertical axis and a, b . . . on the horizontal axis. Thus, the coil 16 corresponding to the coordinates (A, a) can be selected by designating A on the vertical axis and a on the horizontal axis.

For the ease of understanding, the actions involved in the shifting of one needle 34 downwards and then upwards will now be explained.

The action of shifting the needle 34 downwards and then upwards is equivalent to the action of shifting the slider 28 upwards and, then, downwards.

Thus, the rotor 18 is driven and the excitation pattern for the coils 16 is controlled so that the slider 28 first moves upwards and then moves downwards. Thus, the coils 16 in the shaded blocks of FIG. 11 (*c*) are excited, for example in the manner of (A, b), (B, b) . . . (E, j) . . . As mentioned hereinbefore, the plurality of coils 16 are arranged in the form of a grating as viewed by developing the internal circumferential surface of the stationary hollow cylinder 18. Therefore, in order to shift the slider 28 upwards, the coils 16 are successively excited in an ascending series in the rotational direction of the rotor 18. In order to shift the slider 28 downwards, the coils 16 are successively excited in a descending series in the rotational direction of the rotor 18.

As these coils 16 are energized and the rotor 18 revolves from circumferential position a to circumferential position i, the slider 28 displaced upwards under the attractive force of the excited coils 16 reaches the highest point under the attractive force of the coil (F, i).

Then, as the revolving rotor 18 travels from the coil 16 in circumferential position i to the coil 16 in circumferential position p, the slider 28 is shifted down under the attractive force of the excited coils 16, viz. (E, j) etc.

Figure 12:
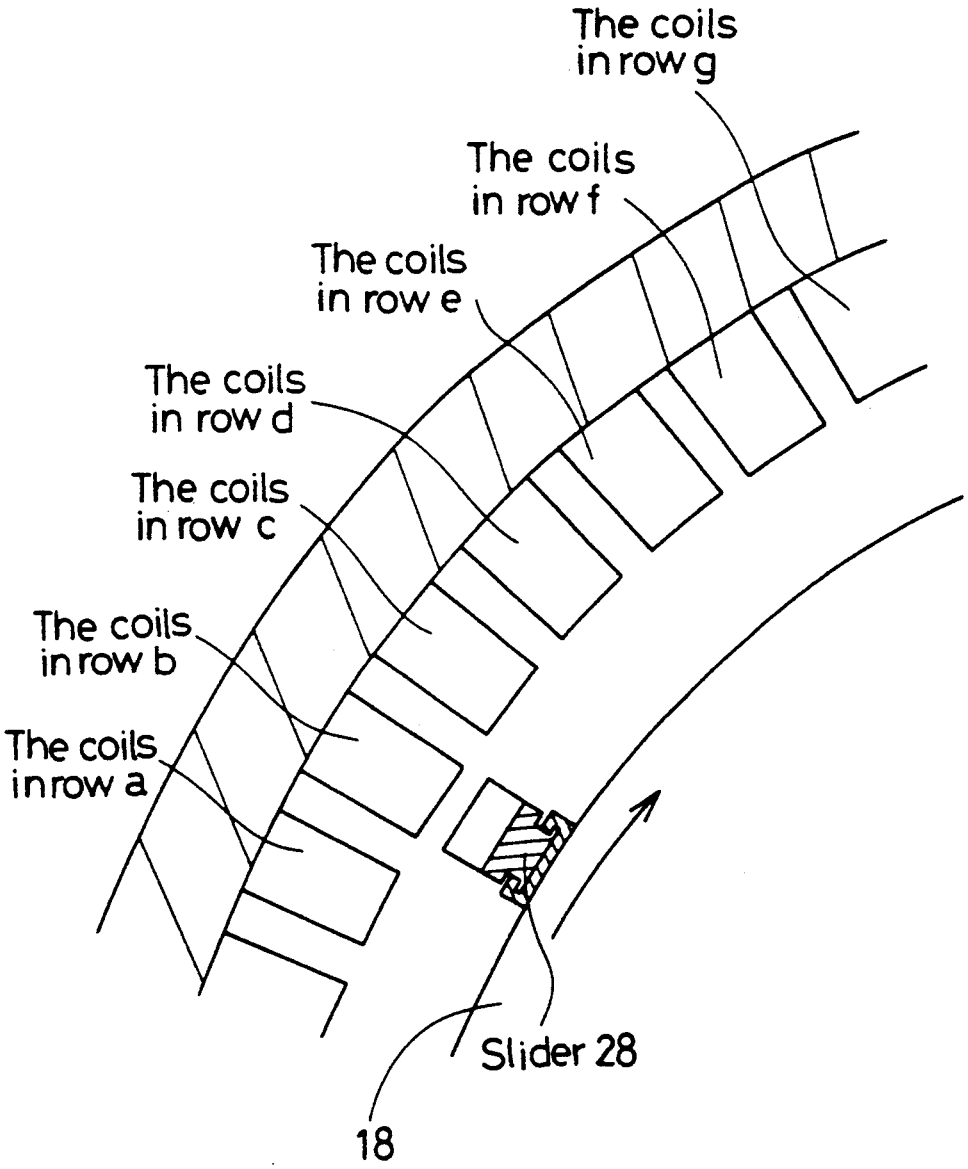
FIG. 12 is a partially exaggerated transverse sectional view showing the stationary hollow cylinder and the rotor.
Figure 13:
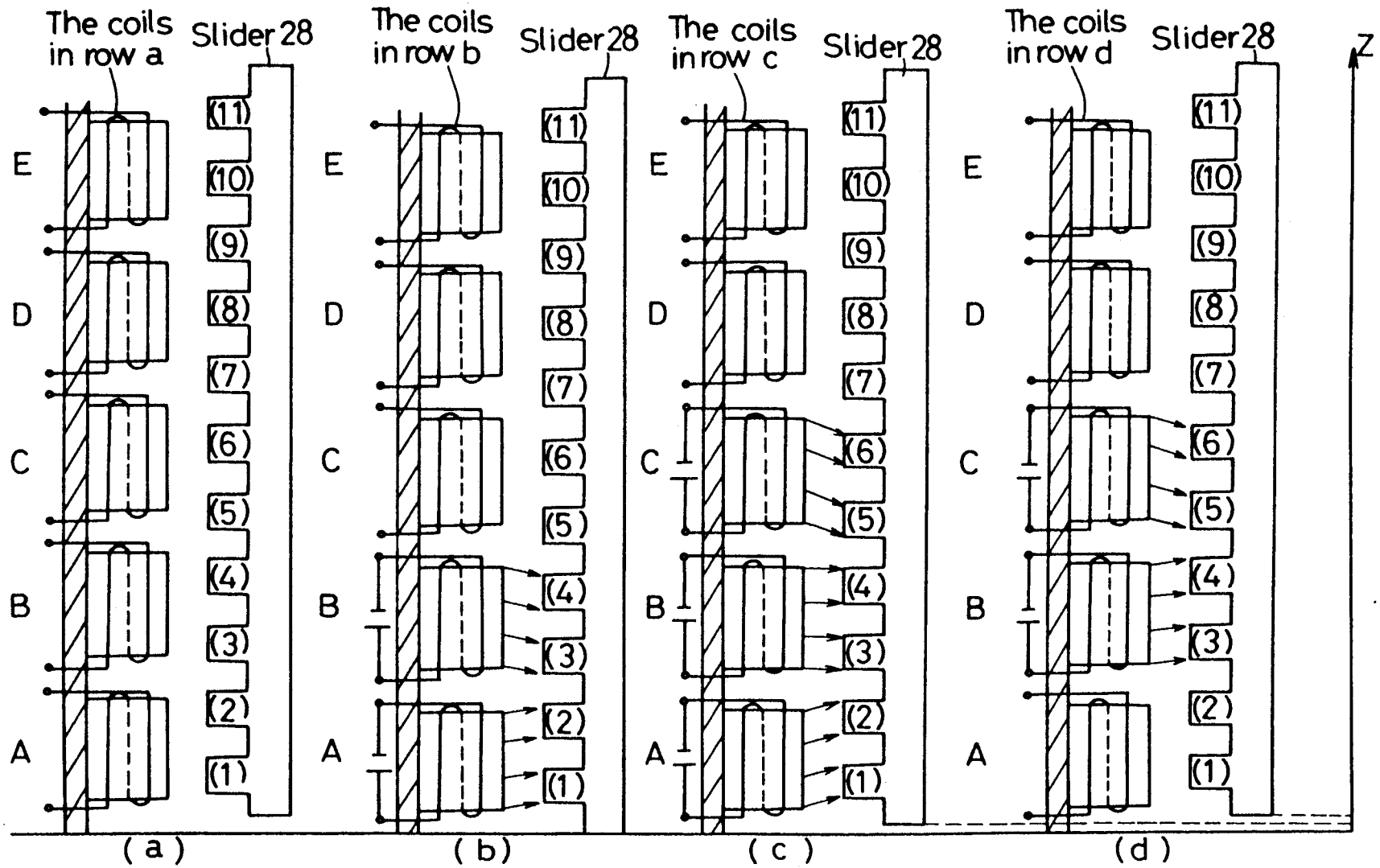
FIG. 13 is a schematic view illustrating the relationship of coils in a row a through row d with the slider.
Figure 14:
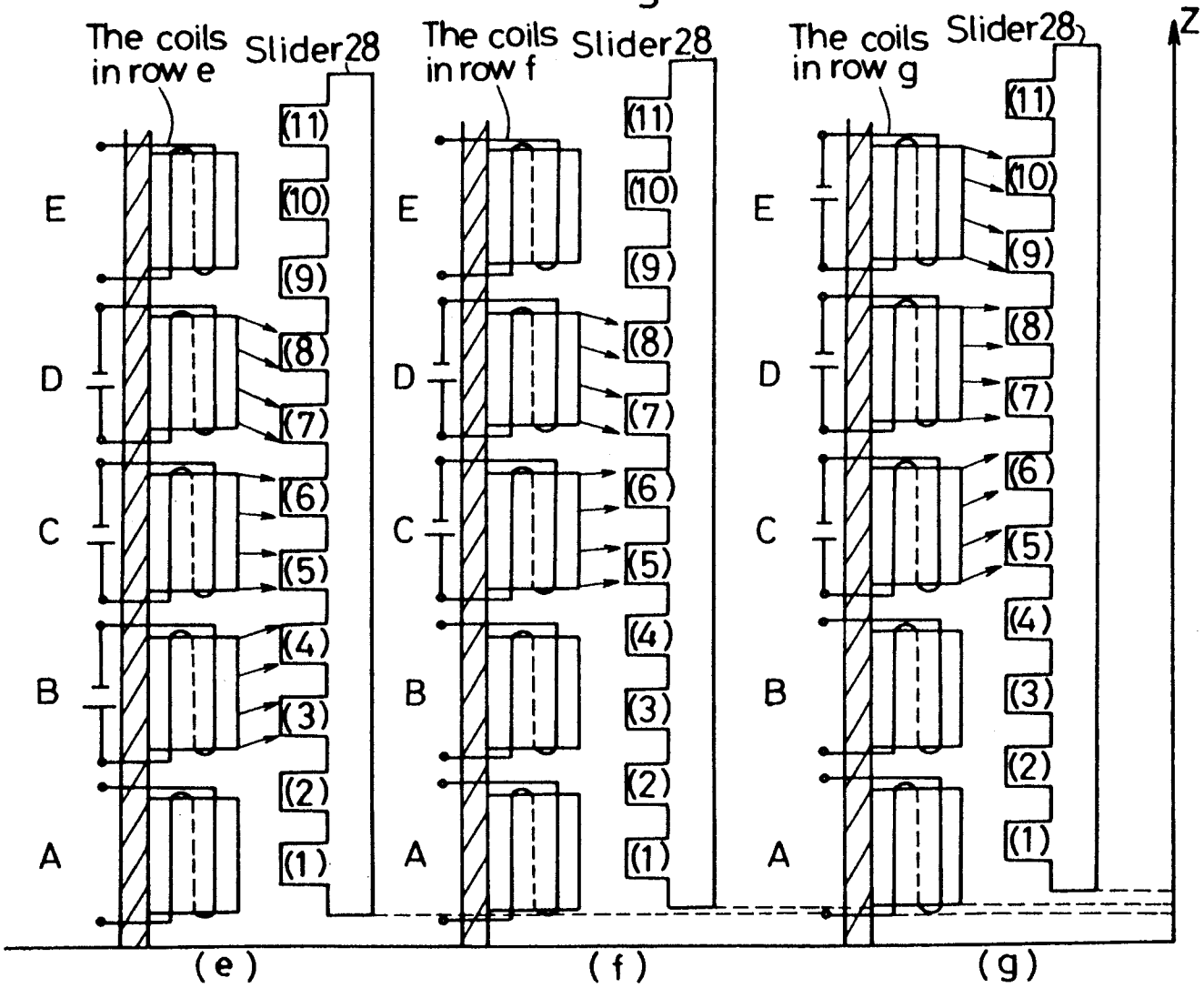
FIG. 14 is a schematic view showing the relationship of coils in rows e through g with the slider.

The relationship of coils 16 to slider 28 will now be explained in greater detail with reference to FIGS. 12–14. In FIG. 12, only one slider 28 is shown for simplicity of explanation. In FIGS. 13 and 14, the plus side of axis Z corresponds to the upper direction of the rotor 18. Movement of a slider 28 may be in accordance with the following sequential steps:

(1) When coil A and coil B in b row are energized, and the slider 28 is rotated from the position facing the coils in row a to the position facing the coils in row b (cf. FIG. 12), the projections (1) through (4) of the slider 28 remain stationary in the position corresponding to a balance of attraction between coil A and coil B (cf. FIG 13 (*b*).

(2) When coil A, coil B and coil C in row c are energized, and the slider 28 is rotated from the position facing the coils in row b to the position facing the coils in row c, the projections (50 and (6) of the slider 28 are attracted towards coil C so that the slider 28 moves towards the plus side of axis Z (upward) and then stops in the position corresponding to a balance of attraction among coil A, coil B and coil C. (FIG. 13 (*c*)).

(3) When coil B and coil C in row d are energized, and the slider 28 rotates from the position facing the coils in row c to the position facing the coils in row d, the force of attraction to projections (1) and (2) of the slider 28 is lost and projections (3) through (6) of the slider 28 are attracted towards coil B and coil C so that the slider moves towards the plus side of axis Z (upward). It stops in the position corresponding to a balance of attraction between coil B and coil C (FIG. 13 (*d*)).

(4) When coil B, coil C and coil D in row e are now energized, and the slider 28 is rotated from the position facing the coils in row d to the position facing the coils in row e, the projections (7) and (8) of the slider 28 are attracted towards coil D so that the slider 28 moves toward the plus side of the axis Z (upward). Then it stops in the position corresponding to a balance of attraction among coil B, coil C and coil D (cf. FIG. 14 (*e*)).

(5) When coil C and coil D in row f are energized, and the slider 28 is rotated from the position facing the coils in row e to the position facing the coils in the row f, the force attracting the projections (3) and (4) of slider 28 is lost and projections (5) through (8) of the slider 28 are attracted towards coil C and coil D so that it is shifted towards the plus side of axis Z (upward). Then it stops in the position corresponding to a balance of attraction between coil C and coil D (cf. FIG. 14 (*f*)).

(6) When coil C, coil D and coil E in row g are energized, and the slider 28 is rotated from the position facing the coils n row f to the position facing the coils in row g, the projections (9) and (10) of the slider 28 are attracted towards coil E so that the slider 28 is shifted towards the plus side of axis Z (upwards). Then it stops in the position corresponding to a balance of attraction among coil C, coil D and coil F. (cf. FIG. 14 (*g*)).

The slider 28 is thus shifted upwards in response to excitation of coils 16 in the above manner. In order to lower the slider 28, the above excitation procedure is performed in a reverse order.

It is thus apparent that the projections of the slider are spaced differently in the vertical direction than the coils, so that selective energization of the coils can effect the incremental vertical movement of the slider 28 as the slider is rotated from alignment with one column of coils to alignment with the adjacent column of coils.

In this manner, the slider 28 moves up and down in response to the rotation of the rotor 18.

Figure 4:
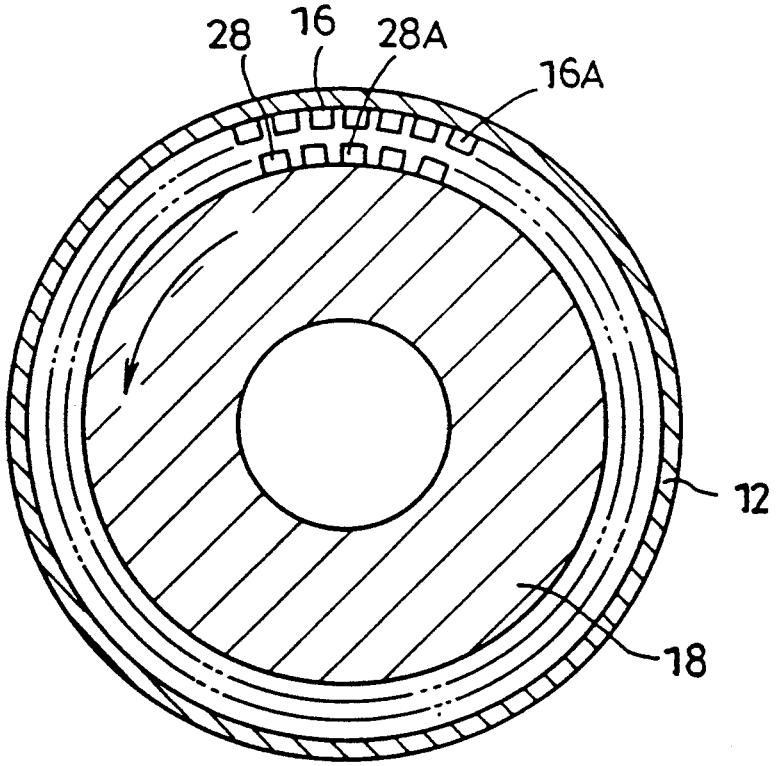
FIG. 4 is a sectional view taken on the line I—I of FIG. 1.

In order to insure an exact geometric relation of the coils 16 with the sliders 28, one reference coil 16A and one reference slider 28A are previously established as shown in FIG. 4. Then, from the timing of the reference slider 28A traversing the reference coil 16A and the detection signal from the rotation detector 50, the setting device 54 constantly monitors the geometric relation of coils 16 with sliders 28. Therefore, the relation between the coil excitation pattern and the action of the sliders 28 is defined o a 1:1 basis so that a fabric conforming to the pattern design can be successfully fabricated.

In this arrangement, it is possible to change the design pattern after, for example, 10 revolutions of the rotor 18 with the aid of the rotation detector 50.

The circular knitting machine 10 according to this embodiment does not employ knitting cams for driving needles 34 but utilizes the principle of a linear motor, i.e. the combination of a plurality of coils 16 and a plurality of sliders 28, to achieve vertical motions of needles 34. In other words, there is no mechanical structure and, hence, the maintenance of the machine is facilitated.

The motion of needles 34 can be easily modified merely by changing the coil excitation pattern.

What is claimed is:

1. A circular knitting machine comprising a stationary hollow cylinder, a rotor disposed within said stationary hollow cylinder and mounted for rotation coaxially with respect to said stationary hollow cylinder, a plurality of coils disposed on the internal circumferential surface of said stationary hollow cylinder, a plurality of sliders disposed in vertically slidable relation on the external circumferential surface of said rotor in positions to be selectively vertically moved in response to magnetic fields produced by energization of the coils of said plurality of coils, needles mounted on top of the corresponding sliders, coil energizing means for selectively exciting the coils of said plurality of coils, and driving means for rotating said rotor.

2. A circular knitting machine according to claim 1 wherein the coils of said plurality of coils are arranged in the form of a grating as viewed by developing the internal circumferential surface of said stationary hollow cylinder, said coil energizing means comprises means for selectively energizing the coils of said plurality of coils, said sliders having means responsive to successive energization of said coils from bottom to top, upon rotation of said rotor, for shifting said sliders upwards, and responsive to successive energization of said coils from top to bottom, upon rotation of said rotor, for shifting said sliders downwards.

3. A circular knitting machine according to claim 2 further comprising an input means for inputting circumferential position and vertical distance data for vertical motions of needles, a coil excitation setting means for setting the coils to be excited according to the circumferential position and vertical distance data from said input means, and coil excitation control means for controlling the coil energizing means to excite the coils selected by said setting means.

4. The circular knitting machine of claim 1 wherein:

said plurality of coils are disposed in the form of a grating as viewed by developing the internal circumferential surface of said stationary hollow cylinder, said coil energizing means comprises means for serially exciting said coils disposed in the manner of a grating in a sequence from bottom to top along the rotational direction of said rotor to generate magnetic attraction forces to cause said sliders on the rotating rotor to be shifted upwards as they traverse said serially excited coils, and said coil energizing means comprises means for serially exciting said coils disposed in the manner of a grating in a sequence from top to bottom along the rotational direction of said rotor to generate magnetic attraction forces to thereby cause the sliders on said rotating rotor to be shifted downward as they traverse said serially excited coils.

5. The circular knitting machine of claim 4 further comprising data input means for inputting circumferential direction data, representing the relative circumferential positions of said stationary hollow cylinder and rotor, for raising and lowering the needles, and distance data representing the vertical distance of movement of one of the needles in said circumferential position, a coil excitation setting means for determining the coils to be excited among said plurality of coils according to the circumferential direction data and distance data input from said input means, and coil excitation control means for controlling said coil energizing means to energize the coils designated by said coil excitation setting means.

* * * * *